United States Patent [19]

Kobayashi et al.

[11] 4,038,452

[45] July 26, 1977

[54] BULKY NON-WOVEN FABRIC

[75] Inventors: Tadahiro Kobayashi; Eiichi Wakita; Hideo Fukuda; Yukio Matsubayashi, all of Fuji, Japan

[73] Assignee: Asahi Kasei Kogyo Kabushiki Kaisha, Osaka, Japan

[21] Appl. No.: 575,226

[22] Filed: May 7, 1975

[51] Int. Cl.[2] ..... D04H 13/00

[52] U.S. Cl. ..... 428/224; 162/157 R; 428/286; 428/288; 428/290; 428/303; 428/362; 428/369; 428/401; 428/515; 428/904

[58] Field of Search ..... 162/157 R; 428/224, 428/234, 235, 252, 288, 298, 299, 300, 301, 302, 303, 289, 290, 370, 296, 156, 904, 162; 264/147, 182

[56] References Cited

U.S. PATENT DOCUMENTS

| | | | |
|---|---|---|---|
| 3,039,913 | 6/1962 | Merrill et al. | 162/157 R |
| 3,436,304 | 4/1969 | Spence | 162/157 R |
| 3,486,970 | 12/1969 | Troemel | 162/157 R |
| 3,701,819 | 10/1972 | Yoshida et al. | 264/182 |
| 3,798,296 | 3/1974 | Thomas | 264/182 |
| 3,809,738 | 5/1974 | Shimoda et al. | 264/182 |
| 3,826,712 | 7/1974 | Masuda et al. | 162/157 R |
| 3,855,056 | 12/1974 | Maeda et al. | 162/157 R |

*Primary Examiner*—James J. Bell
*Attorney, Agent, or Firm*—Armstrong, Nikaido & Marmelstein

[57] ABSTRACT

A bulky non-woven fabric of improved softness and uniformity in surface density, flatness and thickness is provided. The non-woven fabric comprises (a) 50 to 95% by weight of spontaneously crimped acrylonitrile polymer fibers having lengths of 4mm to 20mm and at least 20 crimps per inch of length, said acrylonitrile polymer consisting essentially of, in polymerized form, 80 to 100% by weight of acrylonitrile and 0 to 20% by weight of a copolymerizable monoethylenically unsaturated monomer, and (b) 5 to 50% by weight of fibrillated fibers of at least one acrylonitrile polymer, said acrylonitrile polymer comprising, in polymerized form, 60 to 98% by weight of acrylonitrile and 2 to 40% by weight of a copolymerizable monoethylenically unsaturated monomer having a carboxyl group or an amide or N-alkyl substituted amide group. The non-woven fabric is in the form of a web having a structure such that said spontaneously crimped fibers are entangled with both each other and with said fibrillated fibers, and having an apparent density of 0.05 to 0.25 g/cm$^3$.

5 Claims, 1 Drawing Figure

BULKY NON-WOVEN FABRIC

Figure 1:
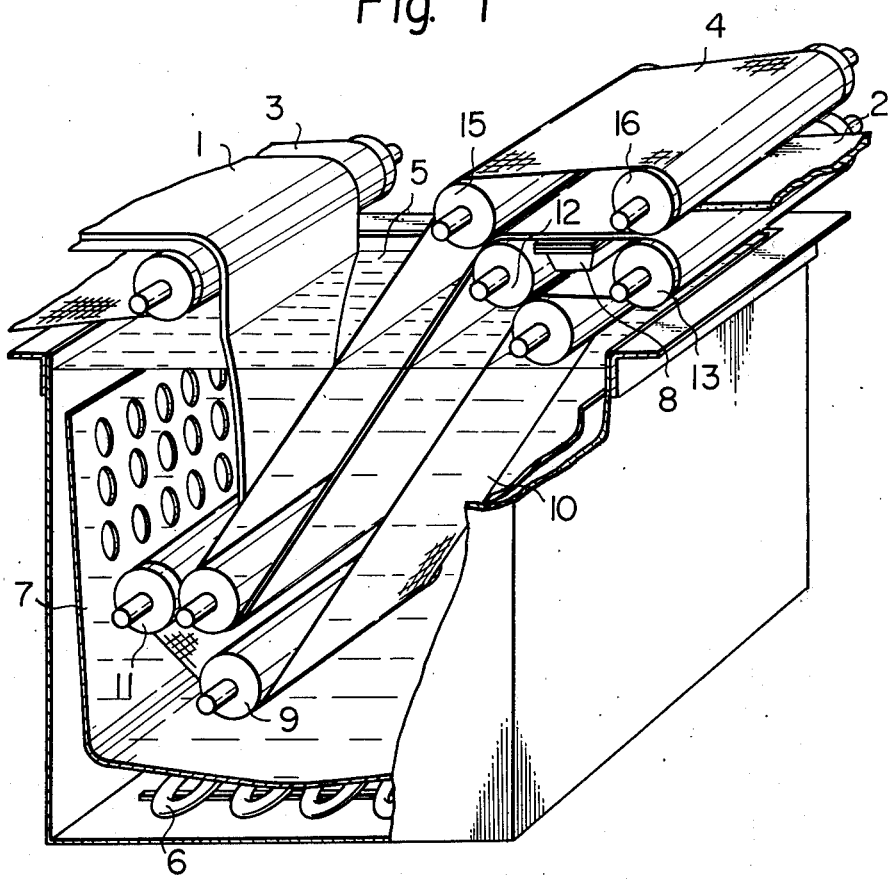

This invention relates to a non-woven fabric and more specifically to a bulky non-woven fabric composed of spontaneously crimped acrylonitrile polymer fibers entangled with fibrillated acrylonitrile polymer fibers, which fabric possesses improved softness and uniformity in flatness and surface density. It further relates to a process for manufacturing such a bulky non-woven fabric.

Many bulky non-woven fabric have been heretofore proposed which are manufactured by a process wherein a web composed of latently crimped thermoplastic fibers is first bonded to provide strength and dimensional stability and then placed under conditions such that crimps spontaneously develop. Such bonding of webs is performed, for example, by needling the web thereby entangling the fibers; embossing the web at elevated temperatures thereby welding in dots; or printing an adhesive in a dotted pattern on the web. However, these bulky non-woven fabrics are poor in either or both softness and uniformity of flatness, and surface density for the following reasons. The web is compressed at the dotted, bonded points and, therefore, spontaneous crimp development is restricted at these bonded points and in the neighborhood of the same.

It also has been proposed to deposit continuous filaments on a condensing screen by applying a water or air stream to form a web and, then, placing the web under conditions such that crimps spontaneously develop. However, the filaments are too long and their movement is too restricted for spontaneous crimp development. The non-woven fabrics so manufactured are poor in uniformity of flatness, and surface density because it is difficult to completely and uniformly deposit filaments on the screen.

Therefore, it is a main object of the present invention to provide a bulky non-woven fabric possessing improved softness and uniformity in flatness, and surface density.

Other objects and advantages of the present invention will be apparent from the following description.

In accordance with the present invention, there is provided a bulky non-woven fabric comprising (a) 50 to 95% by weight of spontaneously crimped acrylonitrile polymer fibers having lengths of 4 mm to 20 mm and at least 20 crimps per inch of length, said acrylonitrile polymer consisting essentially of, in polymerized form, 80 to 100 % by weight of acrylonitrile and 0 to 20% by weight of at least one copolymerizable monethylenically unsaturated monomer, and (b) 5 to 50% by weight of fibrillated fibers of at least one acrylonitrile polymer, said acrylonitrile polymer comprising, in polymerized form, 60 ro 98% by weight of acrylonitrile and 2 to 40% by weight of at least one copolymerizable monoethylenically unsaturated monomer having a carboxyl group or an amide or N-alkyl substituted amide group, said non-woven fabric being in the form of a web of a structure such that said spontaneously crimped acrylonitrile polymer fibers are entangled with each other and with said fibrillated acrylonitrile polymer fibers, and have an apparent density of 0.05 to 0.25 g/cm$^3$.

By the term "spontaneous crimp" used herein is meant crimp which spontaneously develops when latently crimped fibers are maintained at elevated temperatures and a relaxed state. The term "latently crimped fiber" used herein refers to fiber capable of forming spontaneous crimp, which fiber possesses a structure such that two acrylonitrile polymer components different in shrinkage are adherent to each other along the fiber axis so that each constitutes a portion of the fiber surface, i.e. a side-by-side structure, or so that one component constitutes an eccentrically located core and another the sheath, i.e. an eccentrical core-sheath structure.

The non-woven fabric of the invention is characterized by possessing a structure such that the spontaneously crimped fibers are entangled with each other and are caught in and adhere to the fibrils of the fibrillated fibers. The fabric is further characterized by exhibit an apparent density of 0.05 g/cm$^3$ to 0.25 g/cm$^3$. When the apparent density is in excess of the upper limmit, the non-woven fabric is poor in bulkiness and softness. In contrast, it is practically difficult to provide a web having an apparent density lower than the lower limit and a practically acceptable strength.

By the term "apparent density" used herein is meant the ratio of surface density, i.e. weight per unit area (g/cm$^2$), of a web to its thickness (cm). The thickness is determined by holding a web specimen between two circular flat plates, each having 1 cm$^2$ surface area and being arranged in parallel, and measuring the distance between the two plates when a load of 100 g is applied thereto in a direction perpendicular to the plates. By the terms "bulky" and "bulkiness" used herein are meant relatively bulky and relative bulkiness, expressed in terms of relatively small apparent density.

Softness is evaluated by specific stiffness, which is the ratio of stiffness of a web to its surface density. The stiffness is determined in accordance with a 45° Cantilever Test defined in Japanese Industrial Standard L-1079. That is, a strip of web having a width of 2 cm is slid in a direction parallel to its long dimension so that its end projects from the edge of a horizontal surface. The length of overhang is measured when the tip of the specimen is depressed under its own weight to the point where the line joining the tip to the edge of the horizontal surface makes an angle of 45° with the horizontal. The non-woven fabric of the invention has a specific stiffness of preferably below 0.07 cm/(g/m$^2$) and more preferably below 0.04 cm/(g/m$^2$).

One of the ingredients of the non-woven fabric of the invention is spontaneously crimped acrylonitrile polymer fibers having lengths of 4 mm to 20 mm and at least 20 crimps per inch of length. When the length of the fiber is in excess of 20 mm, crimp development is restricted by the inevitably enhanced binding force of the fibers. In contrast, with the length below 4 mm, the non-woven fabric is poor in tensile strength. The larger the number of crimps per inch, the better the non-woven fabric. However, it is difficult to develop crimps of approximately 80 or more per inch. The smaller the radius of curvature of the crimp, the more preferable the non-woven fabric. The acrylonitrile polymer fibers having lengths of 4 to 20 mm and at least 20 crimps per inch, the radius of curvature of which is relatively small, result in a non-woven fabric of the desired apparent density hereinbefore set forth.

The number of crimps per inch in a fiber is determined by the following technique of direct observation. 100 specimen fibers are extracted at random from a web. Each specimen fiber is sandwiched between two thin glass sheets and microphotographed at 20 to 50 magnification. The number of crimps and the length of each fiber are directly observed on each microphotograph. The number of crimps per inch is defined as the number of peaks on one side relative to the fiber axis, which peaks possess a radius of curvature of below 1.5 mm and is expressed as a mean value calculated from those of 100 specimen fibers.

The afore-said spontaneously crimped fibers are comprised of at least two acrylonitrile polymers components different in shrinkage and have a structure such that the two polymer components are adherent to each other along the fiber axis so that each constitutes a portion of the fiber surface, i.e. a side-by-side structure, or so that one component constitutes an eccentrically located core and another the sheath, i.e. an eccentrical core-sheath structure. Each acrylonitrile polymer may be either polyacrylonitrile or a copolymer comprised of, in polymerized form, at least 80% by weight of acrylonitrile and at most 20% by weight of another copolymerizable monoethylenically unsaturated monomer. The copolymer may be either random, block or graft copolymers. These acrylonitrile polymers preferably have an average molecular weight of 30,000 to 150,000. The monoethylenically unsaturated monomer is not critical and selected from known comonomers copolymerizable with acrylonitrile. Illustrative of such monoethylenically unsaturated monomers are acrylic acid, α-chloroacrylic acid and methacrylic acid; alkyl or substituted alkyl esters of these acids, the alkyl or substituted alkyl group having 1 to 8 carbon atoms, such as methyl, ethyl, butyl or β-chloroethyl; amides of these acids such as acrylamide, methacrylamide and α-chloroacrylamide; N-monoalkyl derivatives of these amides, the alkyl group having 1 to 8 carbon atoms; vinyl chloride, vinyl fluoride, vinyl bromide, vinylidene chloride, 1-chloro-1-bromoethylene and methacrylonitrile; vinyl carboxylates such as vinyl acetate, vinyl chloroacetate, vinyl propionate and vinyl stearate; methyl vinyl ketone; N-vinylimides such as N-vinylphthalimide and N-vinylsuccinimide; methylenemalonic acid esters; alkyl vinyl esters; vinyl sulfonic acid; α, -β dicarboxylic acids and their anhdrides and esters; styrene, vinylnaphthalene, vinylpyridine and its alkyl derivatives and vinylimidazole. Instead of copolymerization with acid amides, the nitrile group of the acrylonitrile polymers may be partially converted to amide groups by addition of water after the polymerization. These copolymerizable monoethylenically unsaturated monomers may be used alone or in combination. The acrylonitrile polymers used may be those which are prepared by any known procedures such as for example, aqueous suspenson polymerization and solution polymerization in a suitable solvent such as aqueous nitric acid and dimethylsulfoxide.

Another important ingredient of the non-woven fabric of the invention is fibrillated fibers of at least one acrylonitrile polymer. The fibrillated fibers are characterized as having a plurality of fibrils having diameters finer than 3 microns and lengths more than 50 times their diameters, formed by dividing the fiber in a direction of the fiver axis. The plurality of fibrils are entangled with each other and catch the afore-said spontaneously crimped fibers, thereby to provide a non-woven fabric having the desired apparent density.

The fibrillated fibers are made of either an acrylonitrile polymer or a mixture of two or more acrylonitrile polymers. When the fibrillated fibers are made of a single acrylonitrile polymer, the acrylonitrile polymer consists essentially of, in polymerized form, 60 to 98% by weight of acrylonitrile and 2 to 40% by weight of at least one copolymerizable monoethylenically unsaturated monomer having a carboxyl group or an amide or N-alkyl substituted amide group. Illustrative of such copolymerizable monoethylenically unsaturated monomers are acrylic acid, α-chloroacrylic acid, methacrylic acid, itaconic acid, vinylglycollic acid, vinylacetic acid, acrylamide, methacrylamide, α-chloroacrylamide and N-alkyl substituted derivatives of these acid amides, the alkyl group having 1 to 8 carbon atoms. Of these, acrylic acid, methacrylic acid and acrylamide are preferable. These copolymerizable monoethylenically unsaturated monomers may be used alone or in combination. When the fibrillated fibers are made of a mixture of two or more acrylonitrile polymers, the mixture comprises, in polymerized form, 60 to 98% by weight of acrylonitrile and 2 to 40% by weight of the afore-said monoethylenically unsaturated monomer.

When the amount of the afore-said monoethylenically unsaturated monomer is outside the range of 2 to 40% by weight, it is difficult to provide a fibrillated fiber of the desired fibrils.

The fibrillated fibers are preferably made of a mixture of: (a) 50 to 90% by weight of an acrylonitrile polymer consisting essentially of, in polymerized form, 80 to 100% by weight of acrylontrile and 0 to 20% by weight of other copolymerizable monoethylenically unsaturated monomers, as illustrated with reference to the polymer of the spontaneously crimped fibers, and; (b) 10 to 50% by weight of an acrylonitrile polymer consisting essentially of, in polymerized form, 30 to 90% by weight of acrylonitrile and 10 to 70% by weight of at least one copolymerizable monethylenically unsaturated monomer having a carboxyl group or an amide or N-alkyl substituted amide group as illustrated above. Optionally, the latter polymer may contain, in polymerized form, less than 60% by weight of other copolymerizable monoethylenically unsaturated monomers besides those having a carboxyl group or an amide or N-alkyl substituted amide group. These polymers preferably possess an average molecular weight of 20,000 to 200,000.

The fibrillated fibers are present in amounts of 5 to 50% by weight based on the weight of the non-woven fabric. When the amounts of fibrillated fibers are in excess, the non-woven fabric has undesirably high apparent density and is poor in bulkiness and softness. In contrast, with amounts of less than 5% by weight, the non-woven fabric is poor in tensile strength and uniformity in surface density and flatness.

If desired, other fibrous materials may be incorporated in the non-woven fabric of the invention in amounts of up to 45% by weight based on the weight of the fabric. Such fibrous materials include, for example, wood pulp, and staple fibers of regenerated cellulose fibers, polyamide fibers and polyester fibers. These staple fibers preferably possess lengths of below 25 mm.

Further, binder resins may be incorporated in the non-woven fabric of the invention in amounts of 5% to 45% by weight based on the weight of the fabric. Such binder resins include, for example, a styrene/butadiene copolymer containing at least 20% by weight of styrene, an acrylonitrile/butadiene copolymer containing 20% to 50% by weight of acrylonitrile, a copolymer containing at least 50% by weight of methyl, ethyl, or butyl acrylate or methacrylate and at most 50% by weight of butadiene, styrene or vinyl acetate, polyvinyl acetate, a copolymer of vinyl acetate with ethylene or styrene, natural rubber and urethane rubber.

These binder resins may be appied to the non-woven fabric of the invention, for example, by spraying a latex or solution of the binder resin onto the fabric or impregnating the fabric in a latex of the binder resin. When the amount of binder resin is up to 45% by weight, the resin-impregnated non-woven fabric exhibits improved tensile modulus without appreciable reduction of softness and increase of apparent density. The binder resin applied onto the fabric covers at least part of the surfaces of the spontaneously crimped fibers and the fibrillated fibers, and improves the adhesion between the fibrils and between the fibril and the crimped fiber.

The non-woven fabric of the invention possesses good uniformity in surface density and flatness. Such uniformity is expressed in terms of the internal uniformity parameter and external uniform parameter, as determined as follows.

The internal uniformity parameter is defined as the ratio of standard deviation of thickness of a compressed web to its average thickness. The thickness of a compressed web is measured at 100 points vertically and horizontally spaced 1 cm apart on the fabric, by holding a specimen web between two circular flat plates, each with 1 $cm^2$ of surface area and being arranged in parallel, and measuring the distance between the two plates when a load of 5 Kg is applied thereto in a direction perpendicular to the plates. The non-woven fabric of the invention has an internal uniformity parameter of preferably below 0.15 and more preferably below 0.10. In general, although the internal uniformity parameter of a non-woven fabric of crimped fibers varies greatly depending upon the surface density of the crimp-undeveloped non-woven fabric, the internal uniformity parameter of the non-woven fabric of the invention is very small because the crimp-undeveloped non-woven fabric is comprised of latently crimped fibers with lengths of below 20 mm and, therefore, is uniform in surface density.

The external uniformity parameter is defined as the ratio of the standard deviation of the thickness of a web to its average thickness. This thickness is measured at 100 points spaced 1 mm apart on a line selected at random on the web by a procedure similar to that used for determining the internal uniformity parameter set forth above, except that two circular flat plates are used, each with a surface area of 1 $mm^2$ and a load of 100 mg if applied instead of 5 Kg. The non-woven fabric of the invention has an external uniformity parameter of preferably below 0.15 and more preferably below 0.10.

The non-woven fabric of the invention is manufactured by the following process. That is, the process comprises the steps of:

1. dispersing in water (a) 50 to 95% by weight, based on the weight of the resulting web, of latently crimped acrylonitrile polymer fibers having lengths of 4 mm to approximately 25 mm, said acrylonitrile polymer consisting essentially of, in polymerized form, 80 to 100% by weight of acrylonitrile and 0 to 20% by weight of at least one copolymerizable monoethylenically unsaturated monomer, and (b) 5 to 50% by weight, based on the weight of the resulting web, of fibrillated fibers of at least one acrylonitrile polymer, said acrylonitrile polymer comprising in polymerized form, 60 to 98% by weight of acrylonitrile and 2 to 40% by weight of at least one copolymerizable monoethylenically unsaturated monomer having a carboxyl group or an amide of N-alkyl substituted amide group, and said fibrillated fibers being shrinkable by at least 10% in length when immersed in a hot water bath set forth below and having a beating degree of 100 to 550 cc in terms of Canadian standard freeness (hereinafter referred to "C.S.F." for brevity);

2. forming a web from the aforesaid aqueous dispersion;

3. immersing the web in a hot water bath maintained at a temperature of at least 90° C thereby to develop crimps in the latently crimped fibers and shrink the fibrillated fibers, and then;

4. drying the wet web thereby to provide a web having an apparent density of 0.05 to 0.25 $g/cm^3$.

The latently crimped fibers used are either not shrunk or shrunk to a minor extent in the step of immersing the web in a water bath at least 90° C and, therefore, should have lengths of 4 mm to approximately 25 mm in order to provide the spontaneously crimped fibers having lengths of 4 mm to 20 mm.

The latently crimped fibers may be prepared by known processes wherein at least two acrylonitrile polymers different in thermal shrinkage are formed into so-called side-by-side type composite filaments, i.e. filaments of a structure such that the at least two different polymers are adherent to each other along the fiber axis so that each constitutes a portion of the fiber surface, or so-called eccentrical coresheath type composite filaments, i.e. filaments of a structure such that the two different polymers are adherent to each other along the fiber axis so that one component constitutes an eccentrically located core and another the sheath. The at least two different polymers are separately dissolved in a suitable solvent such as an aqueous solution of nitric acid, rhodanate or zinc chloride or dimethylsulfoxide and, then, the solutions are extruded through a spinneret into composite filaments by a known dry or wet spinning process. The extruded filaments are washed with water, if desired, and then drawn to preferably 5 to 15 times their original length thereby to be made into latently crimped filaments. The drawn filaments may be annealed at temperatures of not higher than 170° C and further drawn to at least 1.05 times their length. The latently crimped filaments so prepared should be capable of developing at least 20 crimps per inch when they are immersed in hot water for 5 seconds at the said temperature as that at which the web is immersed in hot water in the aforesaid step (3) and then dried. The thickness of the latently crimped filaments may be varied within the range of approximately 1 denier to approximately 10 denier, per filament.

The fibrillated fibers used may be prepared by procedures wherein a spinning dope of an acrylonitrile polymer or a mixture of acrylonitrile polymers, said polymer or polymers having the composition set forth above, is spun into filaments by a known spinning procedure, preferably wet spinning procedure, and the filaments are washed with water, if desired, and drawn to at least 3 times their original length, cut into staple fibers having lengths of 3 mm to 15 mm and, then, beaten in a water bath. The drawn filaments have a thickness of preferably approximately 1 to approximately 10 denier, and a shrinkage in hot water as hereinafter referred to.

It is preferable that undried fibers having a gel structure are beaten. For optimum results the undried, gelled fibers to be beaten have a water content such that they retain at least approximately 100% by weight, based on the dry weight of the fibers, of water when they are squeezed at a pressure of 10 $Kg/cm^2$.

Beating may be carried out in a known manner by a suitable beating means such as beater, mill or refiner. Beating is carried out to a degree such that the beaten fibers have a plurality of fibrils having a diameter of less than 3 microns and lengths more than 50 times their diameters, formed by dividing each fiber in a direction of the fiber axis. The desired degree of beating is within the range of 100 cc to 550 cc in terms of C.S.F. A degree of beating lower than this range, i.e. a C.S.F. of larger than 550 cc, means that the fibers do not have the desired fibrils. In contrast, a C.S.F. of lower than 100 cc means that the fibers are beaten in excess and the fibrils are minute in size.

The fibrillated fibers are shrinkable by at least 10% in length when they are immersed in hot water maintained at the same temperature as that employed in the aforesaid step (3). Preferably such shrinkage of the fibrillated fibers falls within the range from 10% lower than the shrinkage of the latently crimped fibers to 10% higher than the shrinkage of the latter fibers. The shrinkage in hot water is determined on filaments before these are cut into staple lengths and beaten, and expressed by the following formula.

% shrinkage $= [(l_1 - l_2)/l_1] \times 100$ where $l_1$ and $l_2$ are lengths of the filaments before and after immersion in hot water and both lengths are measured when the filaments are extended by applying a load of 1.5 g per denier thereto.

In the formation of a web comprising the aforesaid latently crimped fibers and shrinkable fibrillated fibers and, if desired, other fibrous materials set forth hereinbefore, it is preferable to prepare an aqueous slurry of these fibers at a concentration of below 0.5% by weight. Then, a wet web is formed from the aqueous slurry using a paper-making machine. Known paper-making machines may be employed such as a sheet machine, fourdrinier paper machine and cylinder mould machine.

The wet web so formed is, after being dried at a temperature of room temperature to 170° C or still in an undried state, immersed in hot water. In order to enhance the crimp development, it is preferably to squeeze a wet web to a water content of 200% to 1,000% by weight based on the dry weight and, then, immerse the wet web in hot water. The web is immersed in a hot water bath maintained at temperatures of not lower than 90° C but below the boiling point and usually for a period of 3 second to 30 minutes at a relaxed state. When the bath is maintained below 90° C, crimps develop at a far slower rate and only to a limited extent and, therefore, the web is completely or partially broken in the water bath; or, this leads to an undesirable increase in the internal uniformity parameter hereinbefore defined. Similarly, in a water bath maintained at the boiling point, the web is broken and the internal uniformity parameter increases.

Simultaneously with crimp development, the web is shrunk in surface area and increases in thickness. Any outer mechanical force which restricts such dimensional change should not be given. The fibrillated fibers used exhibit shrinkages of at least 10% in hot water and preferably shrinkages falling within the range from 10% lower to 10% higher than the shrinkage of the latently crimped fibers and, therefore, they are capable of being entangled with the crimped fibers without restriction of crimp development. When the shrinkage in hot water of the fibrillated fibers is lower than 10%, the resulting web is of an increased external uniformity parameter and poor in surface flatness.

The procedure of the invention wherein the crimp development is carried out by immersion in hot water is advantageous in the following points.

First, a sufficient quantity of heat is rapidly and uniformly transmitted to the latently crimped fibers. This leads to rapid and uniform crimp development.

Secondly, any force for restricting the crimp development is completely removed in hot water. Such force includes, for example, surface tension of water present in the spaces between fibers of the undrived web before immersion in hot water, and adhesion between fibrils of the dried web before immersion in hot water. In other words, any force for keeping the dimension of the web is removed except for the entangling force between the crimped fibers and fibrils of the fibrillated fibers. Therefore, if other fibrillated fibrous materials such as wood pulp are used instead of the fibrillated fibers of the invention or the latently crimped fibers having lengths shorter than 4mm, the web is liable to be broken in hot water and the internal uniformity parameter increases.

One of the preferred apparatuses for the immersion of a web in hot water is shown in perspective in the FIGURE. In the FIGURE, a crimp-undeveloped web 1 carried on a feed conveyor 3 is continuously fallen into a hot water bath 5 where crimps develop. The crimp-developed web 2 is sandwiched between a pair of endless conveyor belts 4 and 10, hung over rollers 14, 15 and 16 and rollers 9, 11, 12 and 13, respectively, and carried to a dryer part (not shown). Reference numeral 8 is a suction box for dehydrating and cooling the web. Reference numeral 6 is a heating tube and reference numeral 7 is a perforated plate for controlling convection of water.

Then, the wet web is dried preferably in a hot air dryer to provide a bulky web having an apparent density of 0.05 g/cm$^3$ to 0.25 g/cm$^3$ and the desired softness and uniformity in surface density and flatness.

In order to improve smoothness and denseness of the surface texture of the dried web for permitting surface treatment such as printing and surface coating, the web may be subjected to calendering using a pair of rollers. One of the rollers is maintained at a temperature of 120° C and 250° C and the other is maintained at temperatures below 60° C. The linear pressure between the rollers is maintained within the range of 10 g/cm to 5,000 g/cm. The smoothness or denseness of the surface texture of the dried web is expressed in terms of air permeability (sec/100cc) which is determined according to Japanese Industrial Standard P-8117 using a Gurley standard Densometer. The calendered web preferably exhibits an air permeability of more than 7 seconds per 100cc of air. Although the surface texture of the calendered web is dense, the web has a structure and an apparent density, both of which are similar to those of an uncalendered web.

The non-woven fabric of the invention is useful in many fields such as, for example, civil engineering and construction industry, clothing, interior goods, handicraft, miscellaneous goods, artificial leather and agricultural industry.

The invention will be further illustrated but is not intended to be limited, by the following examples in which parts and percentages are by weight unless otherwise specified.

EXAMPLE 1

Preparation of polymers A, B and C

Continuous aqueous suspension polymerization was carried out in the following manner. A monomer feed comprised of 92 parts of acrylonitrile, 8 parts of methyl acrylate, 6 parts of an aqueous 5% ammonium persulfate solution, 30 parts of an aqueous 5% sodium bisulfite solution, 8 parts of an aqueous 5% sulfuric acid solution and 410 parts of pure water was continuously fed into a 10 liter glass reactor fitted with a stirrer. The reaction mixture was maintained at a temperature of 55° C and a pH of 2.5 ± 0.5. The residence time in the reactor was an average of 6 hours. The polymer slurry so prepared was dehydrated, washed and then dried by hot air at 100° C to obtain a copolymer (hereinafter referred to as "polymer A"). The yield was 88%. The polymer A had an average molecular weight of 70,000.

Following the procedure set forth above, continuous aqueous suspension polymerization was carried out wherein a monomer feed comprised of 90 parts of acrylonitrile, 100 parts of an aqueous 10% acrylamide solution, 6 parts of an aqueous 5% ammonium persulfate solution, 30 parts of an aqueous 5% sodium bisulfite solution, 8 parts of an aqueous 5% sulfuric acid solution and 320 parts of pure water was employed. All other conditions remained substantially the same. A copolymer (hereinafter referred to as "polymer B") was obtained with a yield of 85%. The polymer had a molecular weight of 72,000.

Similarly, continuous aqueous suspension polymerization was carried out wherein a monomer feed comprising 80 parts of acrylonitrile, 20 parts of acrylic acid, 6 parts of an aqueous 5% ammonium persulfate solution, 33 parts of an aqueous 5% sodium bisulfite solution, 8 parts of an aqueous 5% sulfuric acid solution and 330 parts of pure water was employed. All other conditions remained substantially the same. A copolymer (hereinafter referred to as "polymer C") was obtained with a yield of 83%. The polymer C had molecular weight of 69,000.

Preparation of latently crimped fiber O 26 parts of each of polymer A and polymer B were dissolved in 140 parts of an aqueous 67% nitric acid solution maintained at 0° C, and each solution was maintained at a vacuum degree of 700 mmHg vac. and a temperature of 0° C for 10 hours thereby to be deaerated. The two spinning dopes so prepared had viscosities of 700 centipoise and 830 centipoise, respectively.

The two spinning dopes were simultaneously extruded at a ration of 1:1 by weight through a spinneret with 120 orifices each having a diameter of 0.06 mm into a coagulation bath of an aqueous 30% nitric acid solution maintained at 0° C. The spinning speed was 5 m/min. The side-by-side composite filaments so prepared were washed in water, drawn to 6 times their original length in a water bath maintained at 100° C, and then, dried by hot air at 100° C. The latently crimped filaments so prepared were of 2 denier per filament. The filaments were then cut into staple fibers, the lengths of which are shown in Table I, below. These staple fibers are hereinafter referred to as "latently crimped fiber O".

Preparation of shrinkable fibrillated fiber P 15 parts of polymer A and 10 parts of polymer C were dissolved in 140 parts of an aqueous 67% nitric acid solution maintained at 0° C, and then the solution was maintained at a vacuum degree of 700 mmHg vac. and a temperature of 0° C for 10 hours thereby to be deaerated. The spinning dope so prepared had a viscosity of 660 centipoise. The spinning dope was extruded through a spinneret with 500 orifices each having a diameter of 0.08 mm into a coagulation bath of an aqueous 30% nitric acid solution maintained at 0° C. The spinning speed was 5 m/min. The filaments so prepared were washed in water and drawn to 7 times their original length in a water bath maintained at 100° C. The filaments were of 3 denier per filament. The filaments were then cut into staple fibers with lengths of 5 mm.

100 g (based on the dry weight) of the staped fibers were beaten by a 2.5 kg loaded, 10 liter TAPPI Standard Niagara Beater charged with 10 liters of water. The beaten fibers (hereinafter referred to as "shrinkable fibrillated fiber P") had a C.S.F. of 300 cc.

Manufacture of non-woven fabrics 90 parts of latently crimped fiber 0 and 10 parts of fibrillated fiber P were dispersed with 1 part of polyacrylamide in 50,000 parts of water. From the slurry so prepared, a web having a surface density of 100 g/m$^2$ was manufactured by using a cylinder mold machine and a suction dehydration means having a working width of 50 cm, at a rate of 1 m/min. The wet web containing 700% of water, so formed, was continuously treated by the apparatus shown in the FIGURE. That is, the wet web 1 was placed on a conveyor 3 and passed through a hot water bath maintained at 98° C. The traveling speeds of conveyors 3 and 4 were 1 m/min and 0.8 m/min, respectively. This permitted 20% shrinkage of the web in the travelling direction between the point at which the web is submerged in the bath and the point at which the web is nipped by the conveyor 4. The distance between the two points set forth above was 0.8 m. The wet web having crimps developed by the immersion in hot water was then dried by hot air at 100° C.

The shrinkages in hot water of the latently crimped fiber O and the fibrillated fiber P were 13% and 18%, respectively. The fiber O had developed 36 crimps per inch when immersed in hot water. Performances of the web are shown in Table I, below.

Table I

| Run No. | Length of latently crimped fiber (mm) | Area shrinkage of web (%) | Surface density (g/m$^2$) | Apparent density (g/m$^3$) | No. of crimps of crimped fiber in web (/inch) | Internal uniformity parameter | External uniformity parameter | Specific softness (cm,m$^2$/g) | Tensile modulus (g/d) |
|---|---|---|---|---|---|---|---|---|---|
| 1 Control | 2.5 | 38 | 160 | 0.11 | 39 | 0.16 | 0.10 | 0.037 | 0.009 |
| 2 | 5 | 45 | 188 | 0.14 | 36 | 0.06 | 0.04 | 0.033 | 0.021 |
| 3 | 12 | 43 | 171 | 0.16 | 34 | 0.08 | 0.06 | 0.032 | 0.055 |
| 4 | 21 | 38 | 161 | 0.18 | 29 | 0.10 | 0.08 | 0.034 | 0.072 |
| 5 Control | 28 | 29 | 135 | 0.26 | 18 | 0.20 | 0.19 | 0.036 | 0.058 |

EXAMPLE 2

Following the procedure set forth in Example 1, webs were manufactured wherein the length of the latently crimped fiber O was 12 mm and the degree of beating of the shrinkable fibrillated fiber P was varied as shown in Table II. All other conditions remained substantially the same. C.S.F. of the shrinkable fibrillated fiber P and performances of the webs so manufactured are shown in Table II, below.

Table II

| Run No. | C.S.F. of fibrillated fiber P | Area shrinkage of web (%) | Surface density (g/m²) | Apparent density (g/m²) | No. of crimps of crimped fiber in web(/inch) | Internal uniformity parameter | External uniformity parameter | Specific softness (cm,m²/g) | Tensile modulus (g/d) |
|---|---|---|---|---|---|---|---|---|---|
| 1 Control | 600 | —*1 | — | — | — | — | — | — | — |
| 2 | 500 | 41 | 176 | 0.15 | 33 | 0.05 | 0.08 | 0.037 | 0.060 |
| 3 | 350 | 43 | 165 | 0.13 | 32 | 0.04 | 0.03 | 0.044 | 0.048 |
| 4 | 150 | 45 | 180 | 0.16 | 35 | 0.07 | 0.06 | 0.040 | 0.061 |
| 5 Control | 80 | —*2 | — | — | — | — | — | — | — |

*1,*2The web was broken in the hot water bath.

EXAMPLE 3

Following the procedure set forth in Example 1, webs were manufactured wherein the length of the latently crimped fiber O was 12 mm and the ratio in the amounts of the latently crimped fiber O to the fibrillated fiber P was varied as shown in Table III, below. Results are shown in Table III, below.

Table III

| Run No. | Ratio of fiber O/ fiber P | Area shrinkage of web (%) | Surface density (g/m²) | Apparent density (g/m³) | No. of crimps of crimped fiber in web(/inch) | Internal uniformity parameter | External uniformity parameter | Specific softness (cm,m²/g) | Tensile modulus (g/d) |
|---|---|---|---|---|---|---|---|---|---|
| 1 Control | 98/2 | —*1 | — | — | — | — | — | — | — |
| 2 | 94/6 | 50 | 200 | 0.10 | 40 | 0.03 | 0.12 | 0.026 | 0.011 |
| 3 | 85/15 | 39 | 164 | 0.14 | 36 | 0.09 | 0.08 | 0.037 | 0.066 |
| 4 | 75/25 | 36 | 156 | 0.23 | 25 | 0.02 | 0.09 | 0.057 | 0.076 |
| 5 Control | 45/55 | 36 | 152 | 0.28 | 18 | 0.05 | 0.16 | 0.083 | 0.100 |

*1The web was broken in the hot water bath.

EXAMPLE 4

Using a monomer feed comprised of 75 parts of acrylonitrile, 25 parts of methacrylic acid, 6 parts of an aqueous 5% ammonium persulfate solution, 30 parts of an aqueous 5% ammonium bisulfite solution and 8 parts of an aqueous 5% sulfuric acid solution, a copolymer having a molecular weight of 77,000 (hereinafter referred to as "polymer D") was produced in a manner similar to that set forth in Example 1. The yield was 88%.

17 parts of polymer A and 8 parts of polymer D were dissolved in 140 parts of an aqueous 67% nitric acid solution maintained at 0° C, and then the solution was deaerated at a vacuum degree of 700 mmHg vac. and at a temperature of 0° C for 10 hours. The spinning dope so prepared had a viscosity of 840 centipoise. The spinning dope was extruded through a spinneret with 500 orifices each having a diameter of 0.08 mm into a coagulation bath of an aqueous 30% nitric acid solution maintained at 0° C. The spinning speed was 5 m/min. The filaments so prepared were washed in water and drawn to 7 times their original length in a water bath at 100° C. The filaments were of 3 denier per filament. The filaments were then cut into staple fibers with 7 mm length.

100 g (based on the dry weight) of the staple fibers were beaten in 10 liter of water under conditions similar to those employed in Example 1 to obtain shrinkable fibrillated fibers (hereinafter referred to as "fibrillated fiber Q") having a C.S.F. of 300 cc.

90 parts of latently crimped fiber O having a length of 12 mm and 10 parts of fibrillated fiber Q were dispersed with 1 parts of polyacrylamide (the same as that used in Example 1) in 50,000 parts of water. From the slurry so prepared, a wet web containing 660% of water was manufactured, immersed in hot water and then dried, in a manner similar to that in Example 1. The shrinkage in hot water of the fibrillated fiber Q was 15%. Performances of the web are shown in Table IV, below.

EXAMPLE 5

A 10 liter glass reactor fitted with a stirrer was charged with 40 parts of acrylonitrile, 170 parts of an aqueous 35% acrylamide solution, 5 parts of an aqueous 50% ammonium persulfate solution, 1 part of an aqueous 10% ferric nitrate solution, 0.5 part of acetylacetone and 825 parts of an aqueous 76% nitric acid solution. The content was maintained at 0° C under an atmosphere of nitrogen for 15 hours while being stirred, to obtain a solution in aqueous nitric acid of a copolymer (hereinafter referred to as "polymer E") having a viscosity of 600 centipoise at 0° C. The yield of polymer E was 98%.

100 parts of the solution of polymer E in aqueous nitric acid, set forth above, 55 parts of polymer A and 275 parts of an aqueous 67% nitric acid solution were mixed and deaerated in a manner similar to that in Example 4 to obtain a spinning dope. Shrinkable fibrillated fibers having a C.S.F. of 310 cc were obtained from the spinning dope in manner similar to those set forth in Example 4.

Following the procedure set forth in Example 4 a wet web was manufactured, immersed in hot water and then dried wherein the afore-said fibrillated fibers were used instead of fiber Q. Performances of the web are shown in Table IV, below. The shrinkage in hot water of the afore-said fibrillated fbiers was 22%.

COMPARATIVE EXAMPLE 1

100 parts of the polymer E solution in aqueous nitric acid, set forth in Example 5, and 4 parts of polyacrylonitrile having a molecular weight of 72,000 were mixed and deaerated in a manner similar to that in Example 1 to prepare a spinning dope having a viscosity of 550 centipoise at 0° C. The spinning dope was spun, washed and drawn in a manner similar to that in Example 1 to obtain filaments of 3 denier per filament. The filaments were cut into staple fibers with 7 mm length. Shrinkable fibrillated fibers having a C.S.F. of 380 cc were obtained from the staple fibers in a manner similar to that in Example 1.

Using 85 parts of latently crimped fiber O having a length of 12 mm and 15 parts of the afore-said fibrillated fibers, a wet web was manufactured in a manner similar to that in Example 1. The web was broken by its immersion in hot water. This is because the fibrillated fiber was comprised of, in polymerized form, 57% by weight of acrylonitrile and 43% by weight of acrylamide and consequently, was not satisfactory.

EXAMPLE 6

25 parts of polymer B used in Example 1 was dissolved in 140 parts of an aqueous 67% nitric acid solution and maintained at 35° C for a period of 24 hours thereby converting the nitrile groups in polymer B to amide groups. The resultant polymer (hereinafter referred to as "polymer F") solution in aqueous nitric acid had a viscosity of 950 centipoise at 0° C. Polymer F proved to contain 35% of acrylamide in polymerized form by elementary analysis of nitrogen.

100 parts of the afore-said polymer F solution in aqueous nitric acid, 45 parts of polymer A and 255 parts of an aqueous 67% nitric acid solution were mixed, and deareated in a manner simmilar to that in Example 4 to prepare a spinning dope. Shrinkage fibrillated fibers having a C.S.F. of 295 cc were obtained from the spinning dope in a manner similar to that set forth in Example 4 except that, before the drawn filaments were cut into staple fibers, an adhesion preventing agent (ACX-86, trade name, supplied by Yoshimura Yu-Kagaku Co., Ltd.) was applied with a pick-up of 0.3% to the drawn filaments and then the drawn filaments were dried by hot air at 80° C.

Following the procedure set forth in Example 4, a web was manufactured wherein the afore-said fibrillated fibers were used instead of fiber Q. Performances of the web are shown in Table IV, below. The shrinkage in hot water of the afore-said fibrillated fibers was 19%.

EXAMPLE 7

100 parts of the polymer F solution in aqueous nitric acid, as set forth in Example 6, was deaerated, spun, washed with water and drawn to 5 times the original length of the spun filaments in hot water at 90° C to obtain filaments of 5 denier per filament. The filaments were cut into staple fibers 7 mm long. Shrinkable fibrillated fibers having a C.S.F. of 400 cc were obtained from the staple fibers in a manner similar to that in Example 1.

Using 20 parts of the fibrillated fibers and 80 parts of latently crimped fiber O having a length of 12 mm, a web was manufactured in a manner similar to that in Example 1. Performances of the web are shown in Table IV, below. The shrinkage in hot water of the afore-said fibrillated fibers was 21%.

EXAMPLE 8

20 parts of polymer A and 5 parts of polymer C, both set forth in Example 1, were dissolved in 140 parts of an aqueous 67% nitric acid solution maintained at 0° C and deaerated in a manner similar to that in Example 1, to obtain a spinning dope having a viscosity of 700 centipoise at 0° C. The spinning dope was spun, washed and drawn in a manner similar to that in Example 1 to obtain filaments of 4 denier per filament. The filaments were cut into staple fibers 5 mm long. Shrinkable fibrillated fibers having a C.S.F. of 450 cc were obtained from the staple fibers in a manner similar to that in Example 1.

Using 20 parts of the fibrillated fibers and 80 parts of latently crimped fiber O having a length of 12 mm, a wet web was manufactured, immersed in hot water and then dried, in a manner similar to that in Example 1. Performances of the web are shown in Table IV, below. The shrinkage in hot water of the afore-said fibrillated fibers was 11%.

COMPARATIVE EXAMPLE 2

20 parts of polymer A and 2 parts of polymer C. both set forth in Example 1, were dissolved in 125 parts of an aqueous 67% nitric acid solution maintained at 0° C, and deaerated in a manner similar to that in Example 1 to obtain a spinning dope having a viscosity of 855 centipoise at 0° C. The spinning dope was spun, washed with water and drawn to 9 times the original length of the spun filaments in a manner similar to that in Example 1 to obtain filaments of 4 denier per filament. The filaments were cut into staple fibers 5 mm long. Shrinkable fibrillated fibers having a C.S.F. of 460 cc were obtained in a manner similar to that in Example 1 from the staple fibers.

Using 20 parts of the fibrillated fibers and 80 parts of latently crimped fiber O, a web was manufactured in a manner similar to that in Example 1. The resulting web was poor in uniformity in thickness, density and flatness due to the fact that the web was partially broken by its immersion in hot water. This results shows that fibrillated fibers containing less than 2% by weight of acrylic acid in polymerized from are not satisfactory.

EXAMPLE 9

28 parts of each of polymer A, set forth in Example 1, and polyacrylonitrile having a molecular weight of 72,000 were separately dissolved in 72 parts of dimethylformamide maintained at 60° C, and then left at a vacuum degree of 700 mmHg vac. and a temperature of 60° C for a period of 10 hours thereby to be deaerated. The two spinning dopes so prepared had viscosities of 510 centipoise and 580 centipoise, respectively.

The two spinning dopes were simultaneously extruded at a ratio of 1 : 1 by weight through a spinneret with 60 orifices each having a diameter of 0.06 mm into a coagulation atmosphere of nitrogen maintained at 190° C. The filaments so formed were drawn to 7 times their original length in hot water at 100° C and then dried by hot air to obtain latently crimped filaments of 1.8 denier per filament. The filaments were cut into lengths of 12 mm.

Using 90 parts of the afore-said staple fibers and 10 parts of shrinkable fibrillated fiber P in Example 1, a web was manufactured. Performances of the web are shown in Table IV, below. The afore-said latently crimped filaments were shrunk by 24% and had developed 25 crimps per inch, when immersed in hot water.

EXAMPLE 10

Using 90 parts of latently crimped fiber O having a length of 12 mm and 10 parts of fibrillated fiber P, a wet web was formed in a manner similar to that in Example 1 and then, dried by a multi-cylinder dryer. The dryer comprised six cylinders each 60 cm in diameter, maintained at 50° C, 60° C, 70° C, 80° C, 80° C and 80° C in that order. The dried web was then immersed in hot water and dried in a manner similar to that in Example 1. Performances of the web are shown in Table IV, below.

EXAMPLE 11

Using 80 parts of latently crimped fiber O having a length of 12 mm, 10 parts of fibrillated fiber P and 10 parts of a non-fibrillated, regenerated cellulose fiber having a thickness of 3 denier and a length of 5 mm, a web was manufactured in a manner similar to that in Example 1. Performances of the web are shown in Table IV, below.

EXAMPLE 12

Using 73 parts of latently crimped fiber O 12 mm long, 7 parts of fibrillated fiber P and 20 parts of beaten wood pulp (NBKP) having a C.S.F. of 300 cc, a wet web was manufactured, immersed in hot water and then dried in a manner similar to that in Example 1. Performances of the web are shown in Table IV, below.

COMPARATIVE EXAMPLE 3

Following the procedure set forth in Example 1, a web was manufactured wherein the latently crimped fiber O used was 12 mm long, and shrinkable fibrillated fiber P was immersed in hot water at 100° C before cutting it into staple lengths thereby to be shrunk, i.e. to remove the shrinkability. Performances of the web are shown in Table IV, below. The web exhibited an undesirably high external uniformity parameter.

COMPARATIVE EXAMPLE 4

Following the procedure set forth in Example 1, a web was manufactured wherein latently crimped fiber O used was 12 mm long and the temperature of the hot water bath was reduced to 89° C. However, the web was broken by its immersion in said hot water bath.

The latently crimped fiber O had developed 26 crimps per inch of the length and was shrunk by 7%, when it was immersed in hot water at 84° C for 5 seconds and then dried at room temperature. The shrinkable fibrillated fiber P used was shrunk by 11% when it was similarly processed. It proved that the desired bulky non-woven fabrics were not obtainable when a wet web was immersed in hot water having temperatures below 90° C.

COMPARATIVE EXAMPLE 5

From a mixture of 85 parts of latently crimped fiber O having a length of 12 mm and 15 parts of beaten wood pulp having a C.S.F. of 300 cc, a wet web was formed, immersed in hot water and then dried. The surface layer of the web was partially separated by its immersion in hot water. The web exhibited undesirably high uniformity parameters as shown in Table IV below. This seems to be due to the fact that beaten wood pulp has no shrinkability.

EXAMPLE 13

The non-woven fabric obtained in Example 1, Run No. 3 was immersed with a doubly diluted solution, the solids contents being 13%, of a polyurethane latex (AU-1, trade name, supplied by Matsumoto Yushi Seiyaku Co.) and squeezed by pinch rollers to such a pick-up that the web contained 300% of water based on the dry weight. Then, the web was dried by hot air of 100° C.

The resin-impregnated non-woven fabric contained 36% of the resin and had performances shown in Table IV, below.

EXAMPLE 14

The non-woven fabric obtained in Example 1, Run No. 3 was subjected to calendering. The calender used was composed of a pair of hard chromium-plated rolls each with 350 mm diameter and 550 mm working width, one of which was fitted with an electrically heated wire therein and capable of being heated to 280° C. The clearance between the two rolls, the linear pressure therebetween and the processing speed were 0 mm, 2 Kg/cm and 10 m/min, respectively. One of the rolls was maintained at 170° C and the other was maintained below 20° C by spraying water thereon.

The non-woven fabric so treated had an air permeability of 10 sec/100 cc, which was one eighth of the untreated non-woven fabric. Only one side of the fabric was smooth. Performance of the fabric are shown in Table IV, below.

EXAMPLE 15

25 parts of each of polymer A in Example 1 and polyacrylonitrile having a molecular weight of 72,000 was dissolved in 75 parts of dimethylsulfoxide and left at a vacuum degree of 700 mmHg vac. for 10 hours thereby to be deaerated. The two spinning dopes so prepared were simultaneously extruded at a ratio of 1:1 by weight through a spinneret with 60 orifices each having a diameter of 0.06 mm into a bath of an aqueous 40% dimethylsulfoxide solution maintained at 25° C. The filaments so formed were drawn 5 times their original length in an aqueous 5% dimethylsulfoxide solution maintained at 100° C, washed with water and dried to obtain latently crimped filaments of 2 denier per filament. The filaments were then cut into staple fibers of 12 mm length.

From a mixture of 92 parts of the afore-said latently crimped staple fibers and 8 parts of shrinkable fibrillated fiber P, a wet web was manufactured, immersed in hot water and then dried in a manner similar to that in Example 1. Performances of the web are shown in Table IV, below. The afore-said latently crimped filaments had developed 34 crimps per inch and was shrunk by 17%, when immersed in hot water.

EXAMPLE 16

11 parts of each of polymer A in Example 1 and polyacrylonitrile having a molecular weight of 72,000 was dissolved in 89 parts of an aqueous 50% sodium rhodanate solution and then left at a vacuum degree of 700 mmHg for 10 hours thereby to be deaerated. The two spinning dopes so prepared were simultaneously extruded at a ratio of 1:1 by weight through a spinneret with 60 orifices each having 0.09 mm diameter into an aqueous 10% sodium rhodanate solution. The filaments so formed were washed with water, drawn to 7 times their original length in hot water at 100° C and then dried to obtain latently crimped filaments each having 3.7 denier per filament. The filaments were cut into lengths of 12 mm.

From a mixture of 90 parts of the afore-said latently crimped staple fibers and 10 parts of shrinkable fibrillated fiber P, a wet web was manufactured, immersed in hot water and then, dried in a manner similar to that in Example 1. Performances of the web are shown in Table IV, below. The afore-said latently crimped filaments had developed 30 crimps per inch and was shrunk by 23%, when immersed in hot water.

TABLE IV

| Example No. | Area Shrinkage of web (%) | Surface density (g/m²) | Apparent density (g/cm³) | No. of crimps of crimped fiber in web(/inch) | Internal uniformity parameter | External uniformity parameter | Specific stiffness (cm,m²/g) | Tensile modulus (g/d) |
|---|---|---|---|---|---|---|---|---|
| 4 | 42 | 170 | 0.15 | 43 | 0.06 | 0.07 | 0.034 | 0.044 |
| 5 | 45 | 180 | 0.13 | 41 | 0.03 | 0.07 | 0.034 | 0.050 |
| 6 | 38 | 162 | 0.14 | 36 | 0.04 | 0.06 | 0.043 | 0.036 |
| Comparative 1 | — | — | — | — | — | — | — | — |
| 7 | 33 | 144 | 0.18 | 27 | 0.10 | 0.11 | 0.040 | 0.046 |
| Comparative 2 | 36 | 140 | 0.23 | 30 | 0.21 | 0.30 | 0.039 | 0.041 |
| 8 | 39 | 166 | 0.18 | 25 | 0.06 | 0.10 | 0.039 | 0.048 |
| 9 | 39 | 170 | 0.10 | 24 | 0.06 | 0.12 | 0.042 | 0.057 |
| 10 | 29 | 139 | 0.23 | 26 | 0.09 | 0.13 | 0.050 | 0.052 |
| 11 | 35 | 166 | 0.21 | 36 | 0.10 | 0.11 | 0.030 | 0.030 |
| 12 | 41 | 183 | 0.19 | 40 | 0.09 | 0.12 | 0.027 | 0.029 |
| Comparative 3 | 42 | 170 | 0.15 | 42 | 0.04 | 0.19 | 0.034 | 0.045 |
| Comparative 4 | — | — | — | — | — | — | — | — |
| Comparative 5 | 40 | 170 | 0.16 | 34 | 0.22 | 0.25 | 0.034 | 0.029 |
| 13 | — | 265 | 0.18 | — | 0.08 | 0.06 | 0.048 | 0.25 |
| 14 | — | 170 | 0.19 | — | 0.08 | 0.03 | 0.040 | 0.101 |
| 15 | 33 | 162 | 0.17 | 27 | 0.10 | 0.11 | 0.030 | 0.046 |
| 16 | 44 | 171 | 0.15 | 29 | 0.07 | 0.06 | 0.031 | 0.039 |

What we claim is:

1. A bulky non-woven fabric comprising (a) 50 to 95% by weight of spontaneously crimped acrylonitrile polymer fibers having lengths of 4mm to 20mm and at least 20 crimps per inch of length, said acrylonitrile polymer fibers consisting essentially of, in polymerized form, 80 to 100% by weight of acrylonitrile and 0 to 20% by weight of at least one copolymerizable monoethylenically unsaturated monomer, and (b) 5 to 50% by weight of fibrillated fibers of at least one acrylonitrile polymer, said acrylonitrile polymer comprising, in polymerized form, 60 to 98% by weight of acrylonitrile and 2 to 40% by weight of at least one copolymerizable monoethylenically unsaturated monomer having a carboxyl group or an amide or N-alkyl substituted amide group, said non-woven fabric being in the form of a web having a structure such that said spontaneously crimped acrylonitrile polymer fibers are entangled with each other and are caught in and adhere to the fibrils of said fibrillated acrylonitrile polymer fibers, and having an apparent density of 0.05 to 0.25 g/cm³.

2. A bulky non-woven fabric according to claim 1 wherein said fibrillated fibers are made of a mixture of ($b_1$) 50 to 90% by weight of a polymer consisting essentially of, in polymerized form, 80 to 100% by weight of acrylonitrile and 0 to 20% by weight of at least one copolymerizable monoethylenically unsaturated monomer, and ($b_2$) 10 to 50% by weight of a polymer consisting essentially of, in polymerized form, 30 to 90% by weight of acrylonitrile and 10 to 70% by weight of at least one copolymerizable monoethylenically unsaturated monomer having a carboxyl group or an amide or N-alkyl substituted amide group.

3. A bulky non-woven fabric according to claim 1 wherein said copolymerizable monoethylenically unsaturated monomer having a carboxyl group or an amide group is at least one monomer selected from the group consisting of acrylic acid, methacrylic acid and acrylamide.

4. A bulky non-woven fabric according to claim 1 which consists essentially of (a) 50 to 95% by weight of said spontaneously crimped acrylonitrile polymer fibers, (b) 5 to 45% by weight of said fibrillated acrylonitrile polymer fibers and (c) 5 to 45% by weight based on the total weight of the components (a) and (b) of binder resin.

5. A bulky non-woven fabric according to claim 1 which has the dense surface texture and an air permeability of more than 7 seconds per 100cc of air.

* * * * *